United States Patent [19]

Enderlin

[11] Patent Number: 5,072,472

[45] Date of Patent: Dec. 17, 1991

[54] CONTINUOUS PROCESS FOR DYEING A TEXTILE THREAD, AND INSTALLATION FOR THE IMPLEMENTATION OF THIS PROCESS

[75] Inventor: Robert Enderlin, Morschwiller Le Bas, France

[73] Assignee: Passap Knitting Machines, Inc., Salt Lake City, Utah

[21] Appl. No.: 392,975

[22] PCT Filed: Dec. 5, 1988

[86] PCT No.: PCT/FR88/00594

§ 371 Date: Aug. 7, 1989

§ 102(e) Date: Aug. 7, 1989

[87] PCT Pub. No.: WO89/05370

PCT Pub. Date: Jun. 15, 1989

[30] Foreign Application Priority Data

Dec. 7, 1987 [FR] France ..... 87 17200

[51] Int. Cl.[5] ..... D06B 5/06; D06B 15/09; D06B 23/00

[52] U.S. Cl. ..... 8/151.2; 8/158; 8/400; 68/13 R; 68/20; 68/207

[58] Field of Search ..... 8/158, 400, 151.2; 68/13 R, 18 R, 20, 207

[56] References Cited

U.S. PATENT DOCUMENTS 3,241,343 3/1966 Yazawa .
3,905,327 9/1975 Daniel .
4,374,322 2/1983 Hoffmann et al. .
4,901,254 2/1990 Dolezalek et al. ..... 8/400 X

FOREIGN PATENT DOCUMENTS 2359726 6/1975 Fed. Rep. of Germany ..... 8/158
2460701 7/1975 Fed. Rep. of Germany ..... 8/158
2531442 10/1976 Fed. Rep. of Germany .
2109421 5/1972 France .
2214249 8/1974 France .
2226217 11/1974 France .
2429288 1/1980 France .
2455111 11/1980 France .
8603235 6/1986 PCT Int'l Appl. .
1395620 5/1975 United Kingdom ..... 8/158
1547661 6/1979 United Kingdom .
1555116 11/1979 United Kingdom ..... 68/13 R
2023193 12/1979 United Kingdom .
2058163 4/1981 United Kingdom .
2114917 9/1983 United Kingdom ..... 8/158

*Primary Examiner*—Philip R. Coe
*Attorney, Agent, or Firm*—Sandler, Greenblum & Bernstein

[57] ABSTRACT

Continuous process for dyeing a textile thread by impregnation under pressure, followed by fluid extraction. The dye solution is applied to the thread in an impregnation enclosure, the thread then passes into a fluid extraction enclosure under which liquid is recovered to regenerate it and reuse it as dye. A regeneration enclosure is connected to an automatic color analyzer and to a calculation unit controlling the dosing apparatus for colorants.

21 Claims, 3 Drawing Sheets

CONTINUOUS PROCESS FOR DYEING A TEXTILE THREAD, AND INSTALLATION FOR THE IMPLEMENTATION OF THIS PROCESS

BACKGROUND OF THE INVENTION

1. Field of the Invention

The present invention relates to a continuous process for dyeing textile thread, particularly thread of synthetic fibers, by impregnation of this thread by means of a dye solution constituted of at least one base colorant dissolved in an appropriate solvent, process in which the thread is passed continuously through an impregnation enclosure containing said solution, then through at least one enclosure for water extraction by compressed air in which one collects a liquid residue from water extraction.

The present invention relates likewise to an installation for the implementation of the process, comprising at least one impregnation enclosure followed by at least one water extraction enclosure, means to pass a textile thread continuously through said enclosures, and a circuit of dye solution passing into the impregnation enclosure and provided with recovery means under this enclosure and under the water extraction enclosure.

2. Discussion of Background and Relevant Information

One of technique for continuously dyeing textile threads is described in the French patent application published under the number 2,429,288 and include passing the threads into at least one dye bath contained in at least one tank fed with dye solution. These tanks usually contain a relatively significant volume of dye solution, to avoid a too rapid decrease in the dye bath. The "correction" of the bath is carried out generally periodically, by manual addition of base colorants, possibly followed by a colorimetric control.

These tanks are constantly fed with new dye solution to compensate for the used portion, and in practice operate at a constant level.

In the technologies using dye baths in which one soaks the threads on reels or skeins, the bath ratio is currently from 1 to 10, i.e. that for 100 Kg of treated products, the bath must Contain approximately 1000 Kg of dye solution. Given that the base colorant is expensive, this technique which is not economical, also poses the ecological problem of evacuation of the remaining solution.

All of the prior techniques have numerous disadvantages that both include economical and technical considerations.

SUMMARY OF THE INVENTION

The present invention proposes to remedy the disadvantages cited above, of the conventional dying procedures and apparatus by making available an economical and precise process for dyeing textile threads, as well as an installation for the implementation of this process.

To this end, the process according to the invention is characterized in that, during the water extraction of the thread, the liquid residue from water extraction in the dye solution is reused, an automatic colorimetric analysis of this solution is performed and if necessary, a correction of color of this solution by addition of appropriate quantities of the base colorant and/or of the solvent is automatically achieved. These quantities are determined automatically with respect to the results of the colorimetric analysis, and the corrected solution is used for the impregnation of the thread in the impregnation enclosure.

If the dye solution is composed of several base colorants dissolved in an appropriate solvent, an automatic colorimetric analysis of the dye solution is performed with a view to determining the content of the solution in each of the base colorants and to automatically achieve, if necessary, a correction of color of the dye solution by adding quantities of the base colorants. Moreover, if necessary, a correction of color of the dye solution is automatically achieved by adding quantities of the base colorants, determined by one unit of calculation with respect to the results of the colorimetric analysis for each of the base colorants contained in the solution.

Preferably, an initial phase of starting the process is performed, in which a colorimetric analysis of gradation of the dye solution is performed, and the results of this analysis in the unit of calculation in the form of reference values is memorized, and subsequently in the process, the results of the colorimetric analysis are automatically compared to these reference values with a view to achieving the correction of color. The colorimetric analysis can preferably be a spectrophotometric analysis.

In a preferred embodiment of the process, the colorimetric analysis is performed on samples diluted with dye solution. Preferably, the diluted samples are prepared by introducing a predetermined volume of dye solution in a predetermined volume of solvent and by agitating this mixture to render it homogeneous. For example, the predetermined volume of solvent is controlled by filling a measured container with this solvent to a first level, and by controlling the predetermined volume of dye solution by injecting into the solvent already contained in the measured container, some dye solution until the mixture reaches a second level.

The installation for the implementation of the process is characterized in that the circuit of dye solution comprises, following the recovery means, automatic correction means to control and correct the quantity of colorant in the dye solution containing the liquid residue from water extraction.

Preferably, the automatic correction means comprise an automatic color analyzer coupled to a calculation unit, respective sources of colorants and solvent, and determining means controlled by the calculation unit to take determined quantities of colorant and/or solvent from the sources and introduce them into the dye solution. The color analyzer can be mounted onto a bypass of the dye solution circuit, and this bypass can be associated with a regeneration enclosure containing a determined volume of dye solution.

In a particular embodiment, the bypass is branched in a closed circuit on the regeneration enclosure, it is equipped with a circulation pump, and the sources are connected to the dye solution circuit by means of this bypass.

Preferably, the device for dilution of the dye solution is interposed on the bypass, between the regeneration enclosure and the color analyzer, and the regeneration enclosure is equipped with reheating means, as well as means for regulation of the temperature and/or pH of the dye solution.

In another particular embodiment, the circuit of dye solution is divided into a first circuit passing through the impregnation enclosure, and a second circuit passing through the water extraction enclosure. The first circuit comprises a recovery tank positioned under the impregnation enclosure and equipped with means for regulation of the temperature and means for controlling the level of the solution. The second circuit successively comprises a recovery tank positioned under the water extraction enclosure, the automatic means for correction and a compensation reservoir, whose outlet is connected to the first circuit through a valve controlled by the means for controlling the level.

BRIEF DESCRIPTION OF THE DRAWINGS

The present invention and its advantages will appear better in the following description of examples of installations according to the invention, with reference to the annexed drawings, in which.

DETAILED DESCRIPTION OF THE PREFERRED EMBODIMENTS

Figure 1:
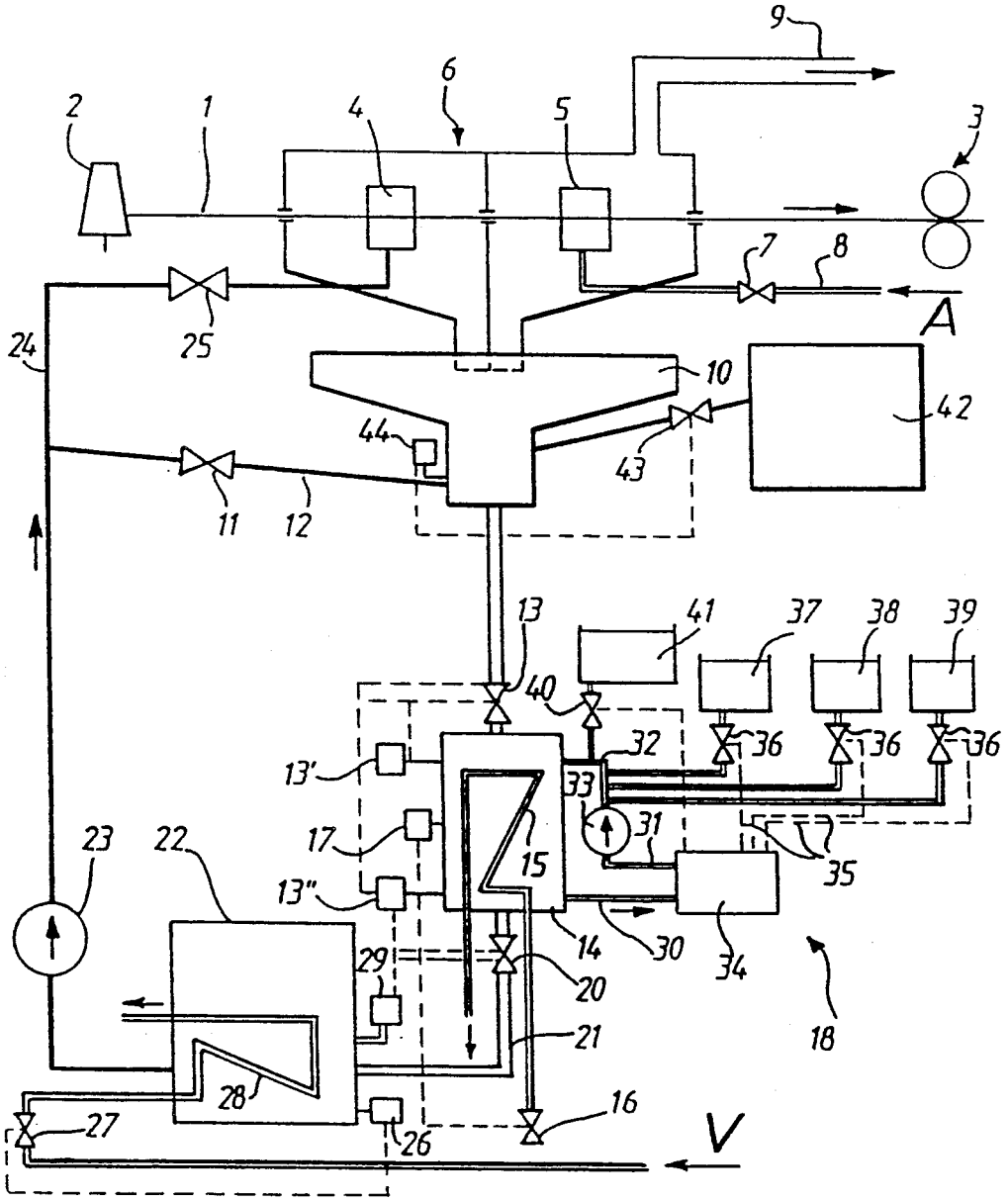
FIG. 1 is a simplified diagram. of the part of a continuous dyeing installation where an impregnation and pneumatic thud extraction of a thread take place, while the rest of the installation can be of a conventional construction.

With reference to FIG. 1, a thread 1 is taken from a spool 2 and it is moved continuously by pulleys 3 through an impregnation enclosure 4 and a pneumatic fluid extraction enclosure 5, which are set in respective compartments of an enclosure 6. In fact, in most cases, several threads 1 move in a parallel fashion and are treated together in the same installation. Beyond the pulleys 3, the thread 1 is generally deposited in the form of spirals on a continuous conveyor which makes it go through a drying enclosure, then a steaming oven for the thermofixation of the colorant, before being rewound on a reel. This non-illustrated portion of the installation is known in its principle and can be the object of various alternatives according to the nature of the thread and the treatments that it must undergo.

In the impregnation enclosure 4, the thread is impregnated by a dye solution which is trichromatic in the present case, i.e., it contains a yellow colorant, a red colorant and a blue colorant in suitable proportions to give the thread 1 the desired color. This solution circulates in a closed circuit which will be described below. In the pneumatic fluid extraction enclosure 5, an excess of dye solution is removed from the thread by injection of compressed air issuing from a source A through an adjustment valve 7 and a conduit 8. This air is evacuated from enclosure 6 by a suction conduit 9. The excess of liquid escaping from the thread and boxes 4 and 5 flows on the bottom of enclosure 6 to fall into a recovery tank 10, which can likewise receive liquid by a bypass 12 furnished with a valve 11 being used to adjust the flow of dye solution going through the impregnation enclosure 4. At the outlet of tank 10, an electrovalve 13 controls the entry of liquid into a regeneration enclosure 14 which, in the present case, is arranged like a preheater containing a circuit of steam 15 fed by a source of steam V through an adjustment valve 16 controlled by a temperature probe 17 (the broken lines represent control connections). Furthermore, enclosure 14 is attached to an automatic regeneration device 18 for the dye solution, which device will be described below.

At the rear of the regeneration enclosure 14, the circuit of dye solution comprises an electrovalve 20 controlling the outlet of enclosure 14 in a conduit 21, a reservoir 22 then a volumetric pump 23 which returns the dye solution towards the impregnation enclosure 4 through a conduit 24 and a stop valve 25. Instead of adjusting the flow by means of valve 11, one could obviously replace the pump 23 with a variable flow pump. The reservoir 22 is also arranged like a steam preheater, to carry the dye solution to a temperature as high as possible without it vaporizing and without it altering the physical properties of thread 1, according to the nature thereof. This temperature is controlled by a probe 26 controlling a valve 27 for admission of the steam V into a circuit of steam 28. In addition, the reservoir 22 is equipped with a detector of minimal level 29 connected to electrovalve 20.

Device 18 for automatic regeneration of the dye solution is connected to enclosure 14 by a closed circuit bypass comprising conduits 30, 31 and 32, a circulation pump 33 and a color analyzer 34, coupled to an electronic calculation unit 34'. This unit receives from analyzer 34 the signals representing the respective values of color density corresponding to each base colorant. It compares these values to respective index values and, if it detects deviations, it emits corresponding correction signals on lines 35 controlling respective outlet valves 36 of three (or more) reservoirs of base colorants 37, 38 and 39, connected to conduit 32 of the bypass. The unit 34' can likewise control a valve 40 connecting to conduit 32 a reservoir 41 of water or another solvent. This device 18 can be used for the formulation of dye formulas, it then suffices to change the index values to obtain different concentrations of colorants.

In the portion of the circuit going from the recovery tank 10 to the reservoir 22, the flow of the liquid is discontinuous. When valve 13 opens, the liquid residue from water extraction contained in the tank 10 flows into the enclosure 14 until its level reaches a maximal level detector 13' which closes valve 13. At this moment, if the level in the tank 10 is less than minimum, it is completed by an input of dye solution issuing from a reserve 42, by virtue of an electrovalve 43 controlled by a minimal level detector 44.

Enclosure 14 being full, the pump 33 then circulates the liquid in device 18 to control its color and correct it if necessary, while a preheating is carried out in enclosure 14.

When the liquid is corrected in color and in temperature, and the level of liquid has gone down in the reservoir 22 until the level of the detector 29, the latter opens the electrovalve 20, so that the enclosure 14 empties into the reservoir 22. A minimal level detector 13" then closes the electrovalve 20 and opens the electrovalve 13 to recommence the cycle.

Figure 2:
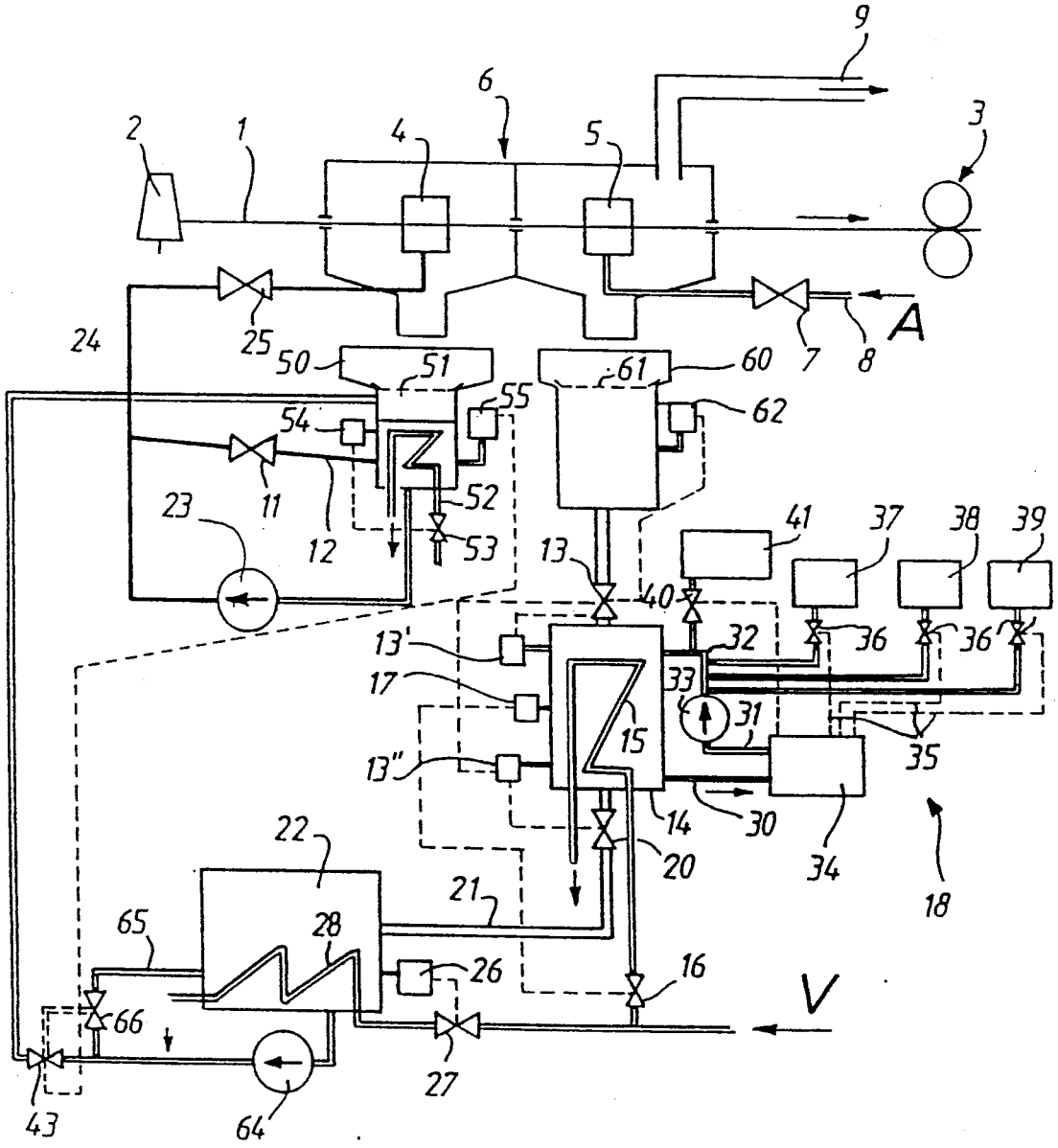
FIG. 2 is a diagram similar to FIG. 1, but shows another embodiment.

In the alternative embodiment illustrated in FIG. 2, a great deal of elements of the installation are similar to those of FIG. 1 and they bear the same reference numbers. In this case, the circuit of the dye solution is composed in fact of a first circuit which is closed and which passes through the impregnation enclosure 4, and of a second circuit which constitutes in fact the return of the liquid from the water extraction enclosure 5 to the reservoir 22, hence the regenerated solution is reinjected in the first circuit wi respect to needs.

In the first circuit, a recovery tank 50 under the impregnation enclosure 4 comprises a filter 51, a preheating circuit 52 provided with a valve 53 controlled by a temperature probe 54 so as to maintain the dye solution at a temperature as high as possible as in the preceding example, and a minimal level detector 55 which controls the electrovalve 43 to complete the level of the bath in the tank 50 beginning With reservoir 22.

Under the pneumatic water extraction enclosure 5, the second circuit comprises another recovery tank 60 equipped likewise with a filter 61 and a maximal level detector 62 which controls the opening of the electrovalve 13 on the outlet of the tank 60, when this tank contains sufficient liquid to fill the enclosure 14, which functions as in the preceding example, in combination with the device 18 ensuring the regeneration of the dye solution. This solution is then stored and kept at the desired temperature in the reservoir 22 which fulfills at the same time the function of reservoir 42 of the preceding example. A circulation pump 64 takes the dye solution to the outlet of reservoir 22, and makes it circulate in a closed circuit 65 controlled by an electrovalve 66, which closes when the electrovalve 43 opens.

With respect to the installation according to FIG. 1, an advantage of this embodiment is that the temperature maintained in the reservoir 22 can be a little lower than that of the solution contained in the first circuit, particularly when the latter is greater than 90° C.

Figure 3:
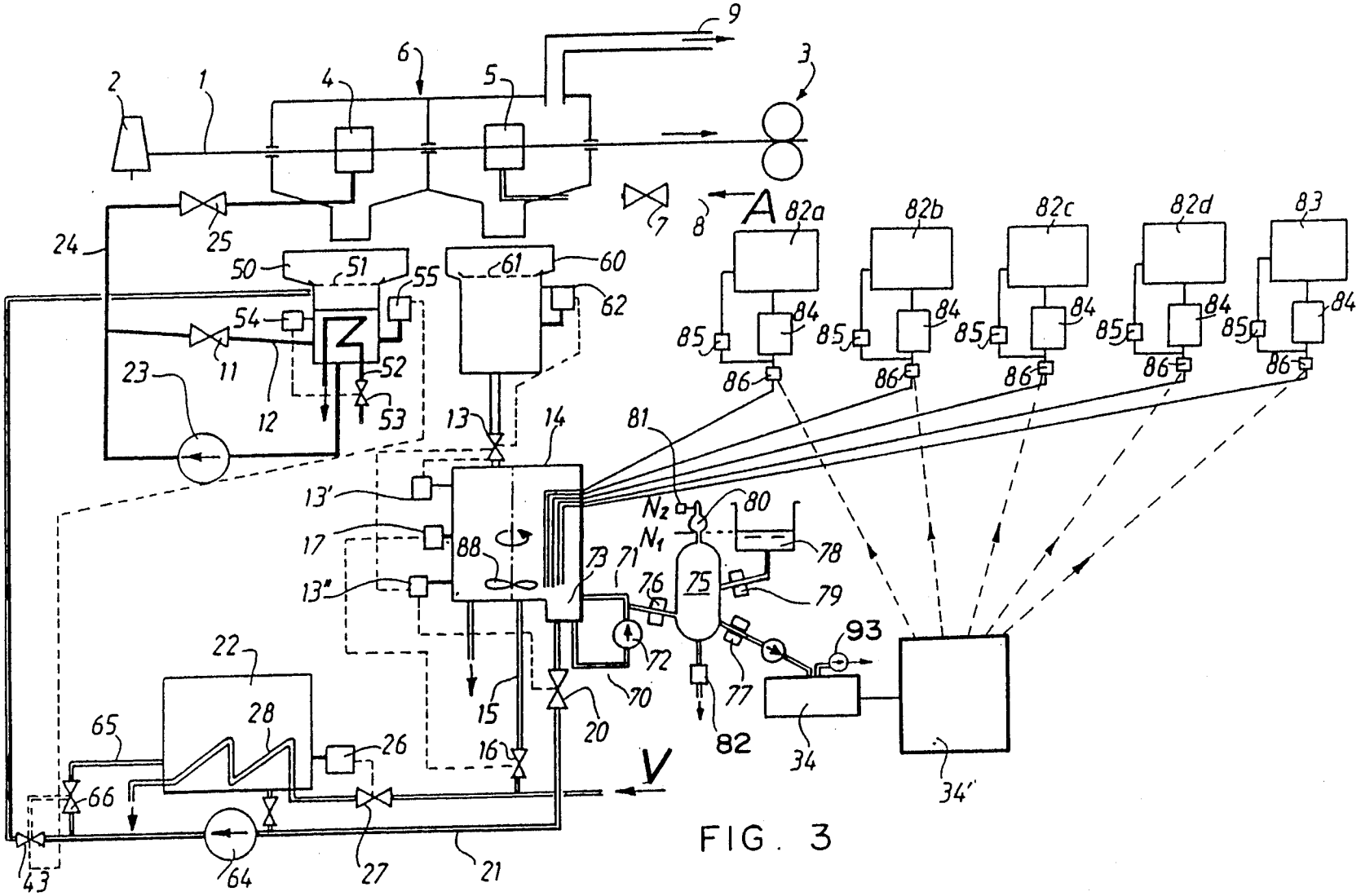
FIG. 3 is a diagram similar to FIG. 2, showing yet another embodiment.

The installation illustrated in FIG. 3 is in large part similar to that of FIG. 2. However, in this case, the colorimetric analysis is done on a sample diluted with the dye solution, taken from a closed circuit bypass 70, 71 of the regeneration enclosure 14. In this bypass the solution within a hollow 73 at the bottom of the enclosure 14 circulates constantly, by virtue of a pump 72. The dilution operation occurs in a container 75 able to communicate with the bypass through a valve 76, and with a water reservoir 78 at constant level N1 through a valve 79. This container is topped by a calibrated balloon 80 equipped with a detector 81 of a higher level N2. FIG. 3 also shows a drainage valve 82 for containers 75 and 80, as well as a pump 93 for feeding and draining of the analyzer.

A sample taking is performed periodically, for example every 2 minutes, on the command of the unit 34, and occurs in the following manner: the container 75 is first filled with water up to level N1 by valve 79. Then the valve 76 is opened to allow the dye solution to enter until the level N2 is reached, which determines a constant ratio of dilution corresponding to the ratio of volumes of containers 80 and 75. An agitator (not shown) homogenizes the diluted solution, then the valve 77 makes it possible for the latter to reach the analyzer 34. After the colorimetric measurement, the analyzer can be rinsed with clear water at the same time as the container 75.

In this example, the calculation unit 34' can control corrections of color in enclosure 14 beginning with four reservoirs of colorants **82*a* to 82*d* and of a solvent reservoir 83. Each of these reservoirs is equipped with a closed circuit for circulation having a pump 84 and a pressure-reducing valve 85, to ensure a distribution pressure and a constant quality of the product distributed. The outlet of each of these circuits, in the direction of the enclosure 14, occurs through a respective dosing apparatus 86 controlled by unit 34'. The determined quantities of colorants or of water are injected near the bottom of the enclosure 14 in the solution, which is agitated by an agitator 88**.

In this example, one notes also that the regenerated solution going out of the enclosure. 14 can be returned by the pump 64 directly into the impregnation circuit, without passing into the reservoir 22.

In a process of the type described above, most textile threads can withstand a dyeing temperature reaching at least 60° C. However, one observes that the efficiency of the dyeing increases with the temperature and, particularly for threads of polyamide, the preferred temperature of the dye solution is on the order of 95° to 98° C. This obviously necessitates an installation which is very much insulated thermally and which consumes a little more energy than a conventional installation. On the other hand, this presents several advantages with respect to the conventional dyeing processes at approximately 30° C.:

better penetration of the colorant in the thread, particularly because the viscosity of the water is divided by three while passing from 30° to 100° C., and suppression of the accumulation of colorants at the contact points of the twisted threads.

practically total elimination of the phenomenon of "frosting" and obtaining of much deeper shades.

thermal pre-fixation of the colorant on fibers already at the stage of impregnation, which limits the risks of bleeding of the colorant during drying and makes it possible, in certain cases, to reduce the steaming time, better resistance of the colors to washing.

One has observed that these advantages are strengthened even more if one uses a distinctly acid dye solution to dye polyamide threads, particularly in place of using conventional dye solutions having a pH of 6–7. In effect, by diminishing the pH, one increases the receptivity of the colorant by virtue of a reaction with the polyamide. With the process according to the present invention, one has obtained excellent results with dye solutions having a pH of 3.5 and a temperature close to 98° C. The control and the correction of the pH can be effected, for example, in enclosure 14.

The present invention is not limited to the embodiments and applications described above, because it can be the object of multiple changes obvious for one with ordinary skill in the art, without going outside the scope defined by the claims. In particular, it does not apply only to the treatment of polyamide threads, but to any other threads capable of being dyed continuously.

On the other hand, it is obvious that the automatic colorimetric analysis can be done in different ways, the technique currently preferred being the spectrophotometric analysis on several wavelengths characteristic of respective colorants and considered either sequentially, or simultaneously. With an appropriate installation, one can envisage carrying out this analysis directly in the circuit of the dye solution, for example in enclosure 14.

I claim:

1. A continuous process for dyeing at least one textile thread by impregnation of the at least one textile thread with a dye solution comprising at least one base colorant dissolved in a solvent, said process comprising the steps of:

(a) providing said dye solution and heating said dye solution to a dyeing temperature of at least 60° C.;

(b) continuously introducing said dye solution into an impregnation enclosure;

(c) continuously passing said at least one textile thread through said dye solution in said impregnation enclosure and then through a flow of compressed air to expel a liquid residue of dye solution from said at least one thread;

(d) continuously recovering and mixing together excess dye solution from said impregnation enclosure and said liquid residue to form a recovered dye solution;

(e) performing an automatic colorimetric analysis of said recovered dye solution, and adding quantities of at least one of said colorant and said solvent to said recovered dye solution to achieve a color correction of said recovered dye solution, with the quantities of colorant and solvent being added being determined automatically by the results of the colorimetric analysis;

(f) preheating said recovered dye solution to a temperature close to said dyeing temperature; and (g) reusing said recovered dye solution in step (a).

2. The process according to claim 1, wherein said at least one textile thread comprises at least one thread composed of synthetic fibers.

3. The process according to claim 1, wherein said solvent is water, and said dyeing temperature is between about 95° C. and 98° C.

4. The process according to claim 3, wherein the pH of said dye solution is adjusted to 3.5.

5. The process according to claim 1, wherein said colorimetric analysis is a spectrophotometric analysis.

6. The process according to claim 1, wherein said colorimetric analysis is performed on diluted samples of said recovered dye solution.

7. The process according to claim 6, wherein said diluted sample is prepared by introducing a predetermined volume of dye solution into a predetermined volume of solvent to obtain a mixture, and agitating said mixture so as to render said mixture homogeneous.

8. The process according to claim 7, wherein said predetermined volume of solvent is obtained by filling a calibrated container with solvent up to a first level, and said predetermined volume of dye solution is obtained by filling said calibrated container containing said predetermined volume of solvent with dye solution until the mixture reaches a second level.

9. The process according to claim 8, wherein said dye solution is injected into said solvent in said calibrated container.

10. The process according to claim 1, wherein said dye solution comprises a plurality of base colorants dissolved in a solvent, and said colorimetric analysis of the dye solution determines the concentration of each of said plurality of base colorants in said dye solution, and automatically performs a color correction of the dye solution by adding any necessary quantities of base colorant determined by a calculation unit based on said colorimetric analysis for each of said plurality of base colorants contained in the dye solution.

11. The process according to claim 10, wherein at an initial phase of the process, a reference colorimetric analysis of said dye solution is performed for said components of said dye solution so as to obtain reference values, and during operation of the process, the results of subsequent colorimetric analysis are automatically compared to the reference values to permit said color correction.

12. The process according to claim 1 wherein the pH of said dye solution is adjusted to 3.5.

13. An installation for continuously dyeing at least one textile thread by impregnation of the at least one textile thread with a dye solution comprising at least one base colorant dissolved in a solvent, said installation comprising:

at least one impregnation enclosure;

at least one fluid extraction enclosure subsequent to said at least one impregnation enclosure to expel excess fluid from the at least one textile thread with compressed air;

means for passing at least one textile thread continuously through said at least one impregnation enclosure and said at least one fluid extraction enclosure; and a dye solution circuit passing through said impregnation enclosure, said dye solution circuit comprising means for recovery of dye solution extending under said at least one impregnation enclosure and under said at least one fluid extraction enclosure to collect and mix together dye solution flowing therefrom, temperature control means for maintaining said dye solution at a dyeing temperature of at least 60° C., and automatic correction means associated with said means for recovery for controlling and correcting a quantity of each base colorant or solvent in recovered dye solution having been collected by said means for recovery.

14. The installation according to claim 13, wherein said temperature control means comprise a steam circuit extending with a dye solution reservoir which is located downstream from said automatic correction means in said dye solution circuit.

15. The installation according to claim 13, wherein said automatic correction means comprise an automatic color analyzer coupled to a calculation unit, respective sources of base colorants and solvent, and determination means controlled by said calculation unit for determining any necessary quantities of at least one of at least one base colorant and the solvent from said respective sources for introduction into the recovered dye solution.

16. The installation according to claim 15, wherein said dye solution circuit includes a regeneration enclosure capable of containing a predetermined volume of dye solution, and said automatic color analyzer is mounted on a bypass associated with said regeneration enclosure.

17. The installation according to claim 16, wherein said bypass is branched as a closed circuit on said regeneration enclosure, and includes a circulation pump.

18. The installation according to claim 17, wherein said respective sources are connected to said dye solution circuit via said bypass.

19. The installation according to claim 16, further including a means for diluting the recovered dye solution inserted in said bypass between said regeneration enclosure and said color analyzer.

20. The installation according to claim 16, wherein said regeneration enclosure includes means for preheating.

21. The installation according to claim 16, wherein said regeneration enclosure includes at least one of means for adjustment of temperature and means for adjustment of pH of said recovered dye solution.

* * * * *